US010684583B2

(12) United States Patent
Nakamoto et al.

(10) Patent No.: US 10,684,583 B2
(45) Date of Patent: Jun. 16, 2020

(54) ABNORMALITY DETECTION DEVICE AND IMAGE FORMING APPARATUS

(71) Applicants: Shogo Nakamoto, Kanagawa (JP); Kazuhiro Kobayashi, Kanagawa (JP); Keiichi Yoshida, Kanagawa (JP); Takuya Murata, Tokyo (JP)

(72) Inventors: Shogo Nakamoto, Kanagawa (JP); Kazuhiro Kobayashi, Kanagawa (JP); Keiichi Yoshida, Kanagawa (JP); Takuya Murata, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/278,227

(22) Filed: Feb. 18, 2019

(65) Prior Publication Data

US 2019/0265626 A1 Aug. 29, 2019

(30) Foreign Application Priority Data

Feb. 27, 2018 (JP) ..... 2018-032828

(51) Int. Cl.
*G03G 15/00* (2006.01)

(52) U.S. Cl.
CPC ..... *G03G 15/55* (2013.01); *G03G 15/5008* (2013.01); *G03G 15/5016* (2013.01); *G03G 15/757* (2013.01)

(58) Field of Classification Search
CPC ..... G03G 15/5008; G03G 15/55
See application file for complete search history.

(56) References Cited

U.S. PATENT DOCUMENTS 8,731,416 B2 * 5/2014 Watahiki ..... G03G 15/5008 399/36
2017/0336748 A1 11/2017 Maejima et al.

FOREIGN PATENT DOCUMENTS

| | | |
|---|---|---|
| JP | H07-295345 | 11/1995 |
| JP | 2012-223069 | 11/2012 |
| JP | 2014-002003 | 1/2014 |
| JP | 2014-002202 | 1/2014 |

* cited by examiner

*Primary Examiner* — Walter L Lindsay, Jr.
*Assistant Examiner* — Arlene Heredia
(74) *Attorney, Agent, or Firm* — Harness, Dickey & Pierce, P.L.C.

(57) ABSTRACT

An abnormality detection device is configured to detect abnormality in a subject to be driven by a motor via a drive transmission member. The abnormality detection device includes an output signal acquisition unit, a rotational frequency acquisition unit, and a determining unit. The output signal acquisition unit is configured to acquire a rotational frequency output signal output from the motor. The rotational frequency acquisition unit is configured to acquire a motor rotational frequency calculated from the rotational frequency output signal acquired by the output signal acquisition unit. The determining unit is configured to distinctively determine abnormality in the subject to be driven and abnormality in the motor based on the rotational frequency output signal acquired by the output signal acquisition unit and the motor rotational frequency acquired by the rotational frequency acquisition unit.

20 Claims, 8 Drawing Sheets

ABNORMALITY DETECTION DEVICE AND IMAGE FORMING APPARATUS

CROSS-REFERENCE TO RELATED APPLICATIONS

The present application claims priority under 35 U.S.C. § 119 to Japanese Patent Application No. 2018-032828, filed on Feb. 27, 2018. The contents of which are incorporated herein by reference in their entirety.

BACKGROUND OF THE INVENTION

1. Field of the Invention

The present invention relates to an abnormality detection device and an image forming apparatus.

2. Description of the Related Art

Conventionally, the device described in Japanese Unexamined Patent Application Publication No. 2012-223069 is known as an abnormality detection device that detects abnormality in a subject to be driven by a motor via drive transmission members. The device stores a plurality of thresholds and performs a determination process based on the rotational frequency of a motor that is determined by a rotational frequency determination unit and the thresholds. In the determination process, when the rotational frequency of the motor is under a first threshold, it is determined that the motor is in a faulty condition (the motor is abnormal) and, when the rotational frequency of the motor is above the first threshold and under a second threshold, it is determined that the motor is in a condition where the load on the motor has increased (a high-load condition). Japanese Unexamined Patent Application Publication No. 2012-223069 exemplifies a motor that drives a fixing roller of an image forming apparatus and attachment of toner onto the fixing roller (subject to be driven) results in the condition where the load on the motor has increased.

The device described in Japanese Unexamined Patent Application Publication No. 2012-223069 separately determines the faulty condition of the motor, that is, abnormality in the motor, and the condition where the load on the motor has increased, that is, abnormality in the subject to be driven. It is however difficult to accurately determine abnormality in the motor and abnormality in the subject to be driven based on only the rotational frequency of the motor and there has been a problem in that, practically, abnormality in the subject to be driven is falsely determined as abnormality in the motor.

SUMMARY OF THE INVENTION

An abnormality detection device is configured to detect abnormality in a subject to be driven by a motor via a drive transmission member. The abnormality detection device includes an output signal acquisition unit, a rotational frequency acquisition unit, and a determining unit. The output signal acquisition unit is configured to acquire a rotational frequency output signal output from the motor. The rotational frequency acquisition unit is configured to acquire a motor rotational frequency calculated from the rotational frequency output signal acquired by the output signal acquisition unit. The determining unit is configured to distinctively determine abnormality in the subject to be driven and abnormality in the motor based on the rotational frequency output signal acquired by the output signal acquisition unit and the motor rotational frequency acquired by the rotational frequency acquisition unit.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
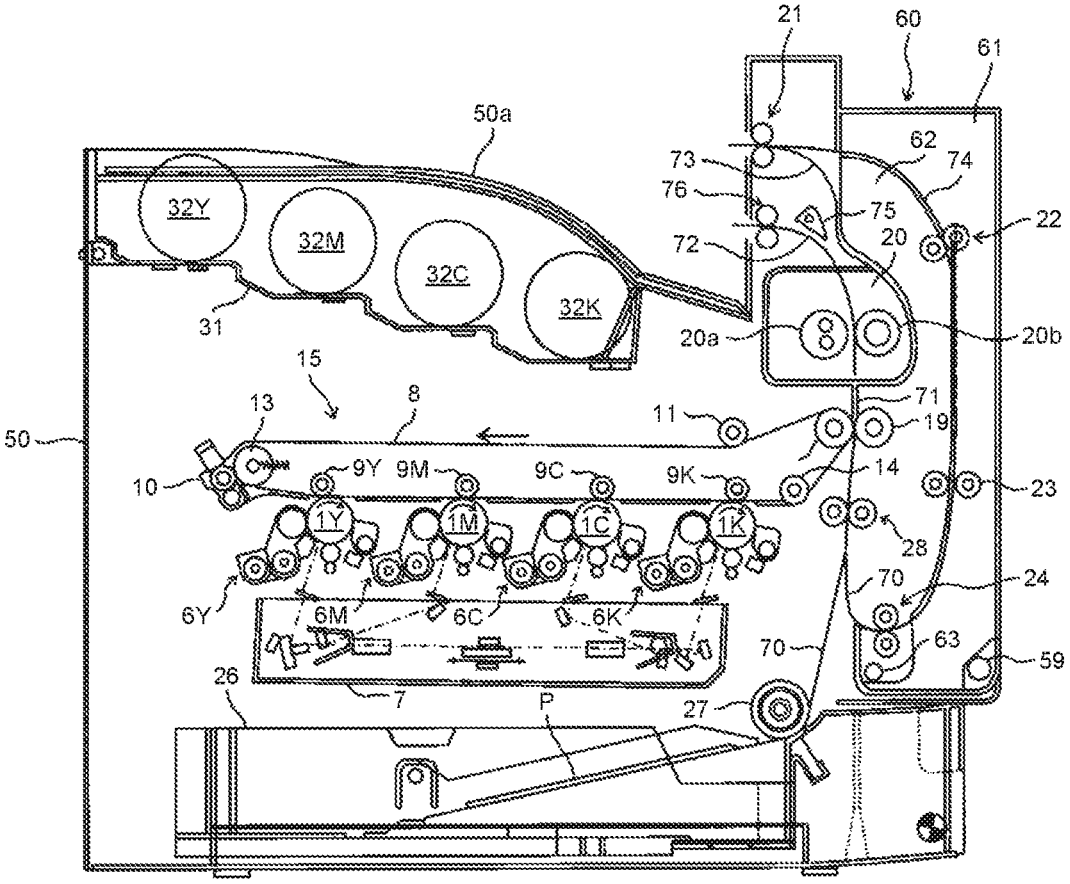
FIG. 1 is a schematic configuration diagram of an image forming apparatus of an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment of an electrophotographic image forming apparatus will be described as an image forming apparatus to which the present invention is applied.

First of all, a basic configuration of the image forming apparatus will be described.

FIG. 1 is a schematic configuration diagram of the image forming apparatus.

Figure 2:
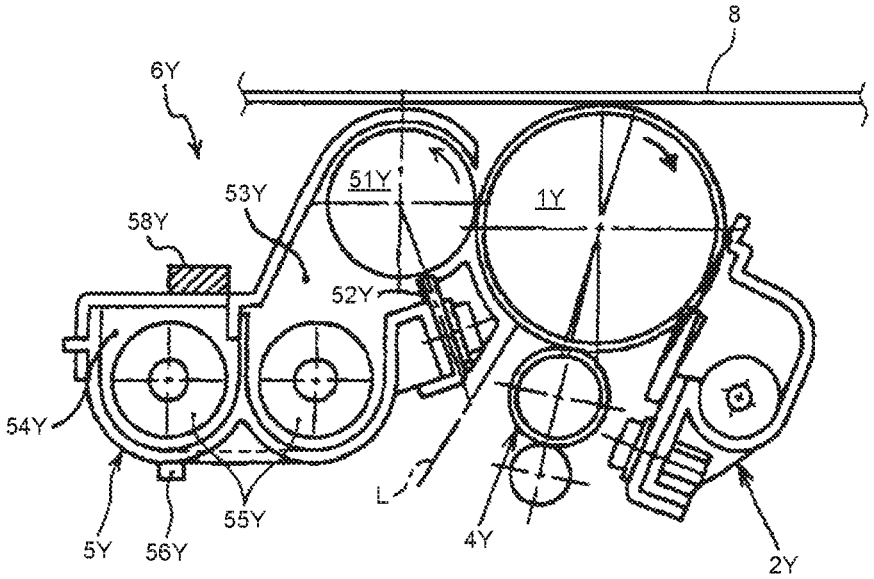
FIG. 2 is an enlarged configuration diagram of an imaging unit for Y in the image forming apparatus.

According to FIG. 1, the image forming apparatus includes four image formation units 6Y, 6M, 6C and 6K for generating toner images of yellow, magenta, cyan and black (respectively referred to as "Y", "M", "C" and "K" below). The image formation units use toners of colors different from one another as color materials and, except for that, the image formation units have the same configuration and are replaced at the end of the life. The imaging unit 6Y for forming a Y toner image will be exemplified. As illustrated in FIG. 2, the image formation unit 6Y includes a drum-shaped photoconductor 1Y serving as a latent image bearer, a drum cleaning device 2Y, a charging device 4Y, and a developing device 5Y. The image formation unit 6Y serving as an image formation unit is detachable as a unit from an image forming apparatus main body. The photoconductor 1Y is driven by a driver to rotate.

The charging device 4Y uniformly charges the surface of the photoconductor 1Y that is caused by the driver to rotate in the clockwise direction in FIG. 2. The uniformly-charged surface of the photoconductor 1Y is exposed to and scanned by a laser light L, thereby bearing an electrostatic latent image for Y. The Y electrostatic latent image is developed by the developing device 5Y using a Y developer containing the Y toner and magnetic carriers into a Y toner image. the Y toner image is then primarily transferred onto an intermediate transfer belt 8, which will be described below. The drum cleaning device 2Y removes the transfer residual toner that is attached onto the surface of the photoconductor 1Y after the primary transfer process with a cleaning blade. In the image formation units 6M, 6C and 6K of other colors, in the same manner, M, C and K toner images are formed respectively on photoconductors 1M, 1C and 1K and the M, C and K toner images are primarily transferred onto the intermediate transfer belt 8 in a superimposed manner.

The developing device 5Y serving as a developing unit includes a developing roller 51Y serving as a developer carrier that is arranged such that the developing roller 51Y is exposed partly from the opening of a casing of the developing device 5Y. The developing device 5Y further includes two conveyance screws 55Y that are arranged in parallel, a doctor blade 52Y and a toner density sensor 56Y.

The Y developer containing the magnetic carriers and the Y toner is stored in the casing of the developing device 5Y. The Y developer is stirred and conveyed by the two conveyance screws 55Y and is charged by triboelectricity and then is carried on the surface of the developing roller 51Y. The thickness of the Y developer is regulated by the doctor blade 52Y and then the Y developer is conveyed to a developing area that is opposed to the photoconductor 1Y for Y and the Y toner is caused to adhere to the Y electrostatic latent image on the photoconductor 1Y. The adherence forms the Y toner image on the photoconductor 1Y. The Y developer whose Y toner is consumed by development in the developing device 5Y is caused to return into the casing in association with the rotation of the developing roller 51Y.

A partition wall is provided between the two conveyance screws 55Y. In the casing, the partition wall divides a first supply unit 53Y that houses the developing roller 51Y, the conveyance screw 55Y on the right in FIG. 2, etc., and a second supply unit 54Y that houses the conveyance screw 55Y on the left in FIG. 2. The conveyance screw 55Y on the right in FIG. 2 is driven by a driver to rotate to supply the Y developer in the first supply unit 53Y while conveying the Y developer from the front side in FIG. 2 to the back side. The Y developer having conveyed by the conveyance screw 55Y on the right in FIG. 2 to the vicinity of the end of the first supply unit 53Y enters the second supply unit 54Y through an opening that is provided in the partition wall. In the second supply unit 54Y, the conveyance screw 55Y on the left in FIG. 2 is driven by a driver to rotate to convey the Y developer sent from the first supply unit 53Y in a direction opposite to the direction in which the conveyance screw 55Y on the right in FIG. 2 conveys the Y developer. The Y developer conveyed by the conveyance screw 55Y on the left in FIG. 2 to the vicinity of the second supply unit 54Y returns into the first supply unit 53Y through another opening that is provided in the partition wall.

The toner density sensor 56Y is formed of a magnetic permeability sensor. The toner density sensor 56Y is provided on the bottom wall of the second supply unit 54Y and outputs a voltage of a value corresponding to the magnetic permeability of the Y developer that passes above the toner density sensor 56Y. The magnetic permeability of a two-component developer containing toner and magnetic carriers represents a preferable correlation with the toner density and thus the toner density sensor 56Y outputs a voltage of a value corresponding to the Y toner density. The value of the output voltage is transmitted to the controller. The controller includes a RAM that stores Vtref for Y that is a target value of the output voltage from the toner density sensor 56Y. The RAM further stores data of Vtref for M, Vtref for C, and Vtref for K that are target values of the output voltages from the toner density sensors that are mounted on other developing devices.

Vtref for Y is used to control driving the toner conveyance device for Y. Specifically, the controller controls driving the toner conveyance device for Y to supply the Y toner to the second supply unit 54Y such that the value of the output voltage from the toner density sensor 56Y approximates to Vtref for Y. The supply maintains the Y toner density in the Y developer in the developing device 5Y within a predetermined range. Similar toner supply control is performed on the developing devices of other process units.

According to the above-described FIG. 1, an optical writing device 7 serving as a latent image formation unit is arranged under the image formation units 6Y, 6M, 6C and 6K. The optical writing unit 7 scans the photoconductors of the respective image formation units 6Y, 6M, 6C and 6K with the laser light L that is emitted based on image information. The scanning forms electrostatic latent images for Y, M, C and K on the photoconductors 1Y, 1M, 1C and 1K, respectively. The optical writing device 7 irradiates the photoconductors with the laser light L that is emitted from the light source via a plurality of optical lenses and mirrors while scanning the photoconductors with a polygon mirror that is driven by a driver to rotate.

A sheet housing unit including a sheet housing cassette 26 and a feeding roller 27 that is incorporated in the sheet housing cassette 26 is arranged on the lower side in FIG. 1. In the sheet housing cassette 26, multiple recording sheets P that are sheet-type recording media are stacked and housed and the feeding roller 27 makes contact with the top recording sheet P. When the feeding roller 27 is caused by a driver to rotate in the counterclockwise direction in FIG. 1, the top recording sheet P is sent out to a sheet supply path 70.

A registration roller pair 28 is arranged near the end the sheet supply path 70. Both the rollers of the registration roller pair 28 are rotated to interpose the recording sheet P in between and rotation of the rollers is stopped temporarily right after the recording sheet P is interposed between the rollers. Rotation of the rollers is restarted at proper timing to send the recording sheet P to a secondary transfer nip, which will be described below.

A transfer unit 15 in which the intermediate transfer belt 8 serving as an intermediate transfer member is moved endlessly, being kept tensioned, is arranged above the image formation units 6Y, 6M, 6C and 6K in FIG. 1. The transfer unit 15 includes, in addition to the intermediate transfer belt 8, a secondary transfer bias roller 19 and a cleaning device 10. The transfer unit 15 further includes four primary transfer bias rollers 9Y, 9M, 9C and 9K, a drive roller 12, a cleaning backup roller 13 and a secondary transfer nip entry roller 14. Being wound around each of the rollers, the intermediate transfer belt 8 endlessly moves in the counter-clockwise direction in FIG. 1 according to rotation of the drive roller 12 that is driven by a drive unit.

The primary transfer bias rollers 9Y, 9M, 9C and 9K interpose the intermediate transfer belt 8 that moves endlessly as described above between the primary transfer bias rollers 9Y, 9M, 9C and 9K and the photoconductors 1Y, 1M, 1C and 1K to form primary transfer nips, respectively. A primary transfer bias having polarity opposite to that of the toner (for example, positive polarity) is applied to the primary transfer bias rollers 9Y, 9M, 9C and 9K. The rollers excluding the primary transfer bias rollers 9Y, 9M, 9C and 9K are all electrically grounded.

On the intermediate transfer belt 8, in a process of sequentially passing through the primary transfer nips for Y, M, C and K in association with the endless move, the Y, M, C and K toner images on the photoconductors 1Y, 1M, 1C and 1K are primarily transferred in a superimposed manner. Thus, four-color superimposed toner image (hereinafter, four-color toner image) is formed on the intermediate transfer belt 8.

The drive roller 12 interposes the intermediate transfer belt 8 between the drive roller 12 and the secondary transfer bias roller 19, thereby forming a secondary transfer nip. The four-color toner image that is formed on the intermediate transfer belt 8 is transferred onto the recording sheet P at the secondary transfer nip. The four-color toner image is combined with white of the recording sheet P into a full-color toner image. The secondary transfer bias roller 19 and the drive roller 12 serving as an intermediate transfer member are generally formed of rubber in consideration of transferability onto a recording sheet.

The transfer residual toner that has not transferred onto the recording sheet P is attached to the intermediate transfer belt 8 after passing through the secondary transfer nip. The residual toner is cleaned by the cleaning device 10. The recording sheet P onto which the four-color toner image has been transferred secondarily at the secondary transfer nip is sent to a fixing device 20 via a post-transfer conveyance path 71.

In the fixing device 20, a fixing roller 20*a* that includes a heat generation source, such as a halogen lamp, inside and a pressure roller 20*b* that rotates, contacting the fixing roller 20*a* by a predetermined pressure, form a fixing nip. The recording sheet P that is sent into the fixing device 20 is interposed in the fixing nip such that the surface of the recording sheet P on which the unfixed toner image is carried adheres to the fixing roller 20*a*. Because of the effect of application of heat and pressure, the toner in the toner image is softened and thus the full-color image is fixed onto the recording sheet P.

The recording sheet P on which the full-color image is fixed in the fixing device 20 goes out of the fixing device 20 and then approaches the bifurcation between a paper ejection path 72 and a pre-reverse conveyance path 73. A first switch claw 75 is arranged swingably at the bifurcation and the swing switches the course of the recording sheet P. Specifically, the tip of the claw is moved to be in a direction in which the tip of the claw gets close to the pre-reverse conveyance path 73 to direct the course of the recording sheet P toward the paper ejection path 72. Furthermore, moving the tip of the claw to be in a direction in which the tip of the claw gets away from the pre-reverse conveyance path 73 directs the course of the recording sheet P toward the pre-reverse conveyance path 73.

When the route to the paper ejection path 72 is chosen with the first switch claw 75, the recording sheet P from the paper ejection path 72 passes through a paper ejection roller pair 76 and then is stacked on a stacker 50*a* that is provided outside the apparatus and that is provided on the top surface of the image formation device casing. On the other hand, when the route to the pre-reverse conveyance path 73 is chosen with the first switch claw 75, the recording sheet P passes through the pre-reverse conveyance path 73 and then enters the nip between the rollers of a reverse roller pair 21. The reverse roller pair 21 conveys the recording sheet P interposed between the rollers to the stacker 50*a* and rotates the rollers reversely right before the rear end of the recording sheet P enters the nip. The reverse rotation conveys the recording sheet P in a direction opposite to that in which the recording sheet P has been conveyed and the rear end side of the recording sheet P enters a reverse conveyance path 74.

The reverse conveyance path 74 has a shape curbing and extending downward from the vertically upper side and has a first reverse conveyance roller pair 22, a second reverse conveyance roller pair 23, and a third reverse conveyance roller pair 24. The recording sheet P is conveyed while sequentially passing through nips of the respective roller pairs, thereby being reversed. The recording sheet P after being reversed is returned to the aforementioned sheet supply path 70 and then reaches the secondary transfer nip again. The recording sheet P then enters the secondary transfer nip with its surface (back surface) not bearing any image adhering to the intermediate transfer belt 8 and thus the secondary four-color toner image on the intermediate transfer belt 8 is secondarily transferred onto the back surface of the intermediate transfer belt 8. The recording sheet P is then stacked on the stacker 50*a* outside the apparatus via the post-transfer conveyance path 71, the fixing device 20, the paper ejection path 72 and the paper ejection roller pair 76. Such reverse conveyance forms full-color images respectively on both surfaces of the recording sheet P.

A bottle supporter 31 is arranged between the transfer unit 15 and the stacker 50*a* above the transfer unit 15. The bottle supporter 31 mounts toner bottles 32Y, 32M, 32C and 32K serving as toner storages that stores Y, M, C and K toners. Each of the Y, M, C and K toners in the toner bottles 32Y, 32M, 32C and 32K are properly supplied by the toner conveyance devices to the development units of the image formation units 6Y, 6M, 6C and 6K. The toner bottles 32Y, 32M, 32C and 32K are detachable from the image formation device main unit independently of the image formation units 6Y, 6M, 6C and 6K.

The reverse conveyance path 74 is formed inside an open-close door that includes an external cover 61 and a swing supporter 62. Specifically, the external cover 61 of the open-close door is supported such that the external cover 61 pivots on the center of a first pivot shaft 59 that is provided in a casing 50 of the image forming apparatus main unit. The pivoting enables the external cover 61 to open and close the opening of the casing 50. The swing supporter 62 of the open-lose door is supported by the external cover such that opening the external cover 61 exposes the swing supporter 62 of the open-close door to the outside and the swing supporter 62 pivots on a second pivot shaft 63 that is provided in the external cover 61. The pivoting causes the swing supporter 62 to swing with respect to the external cover 61 being open from the casing 50 and thus separates the external cover 61 and the swing supporter 62, thereby exposing the reverse conveyance path 74. Exposing the reverse conveyance path 74 enables easy removal of a sheet jammed in the reverse conveyance path 74.

The image forming apparatus according to the embodiment includes various units, including the photoconductors 1Y, 1M, 1C and 1K and the drive roller 12 of the intermediate transfer belt 8, to be driven by motors. When abnormality occurs in driving the units to be driven, there is a risk that proper image formation operations would not be performed or a failure would be caused and thus it is preferable that abnormalities are detected promptly. In the embodiment, an abnormality detection device that detects abnormalities (including abnormalities in motors and abnormalities in photoconductors) in the example where the photoconductors 1Y, 1M, 1C and 1K are units to be driven that are subjects to be driven will be described. In the following descriptions, Y, M, C and K that are reference alphabets specifying colors will be omitted properly.

FIGS. 3A to 3E are schematic diagrams of exemplary configurations of the drive unit that drives the photoconductor 1.

Figure 3A:
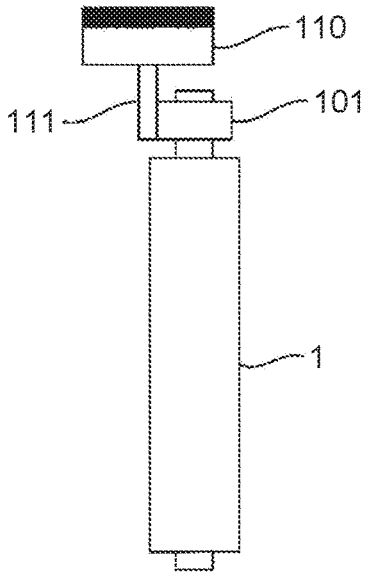
FIGS. 3A to 3E are schematic diagrams of exemplary configurations of a drive unit that drives a photoconductor in the image forming apparatus.

The exemplary configuration illustrated in FIG. 3A is a configuration in which the motor of a motor unit 110 servers as a drive source and a photoconductor gear 101 that is provided on the rotation shaft of the photoconductor 1 is connected to a motor gear 111 that is provided on the output shaft of the motor to drive the photoconductor 1 to rotate.

Figure 3B:
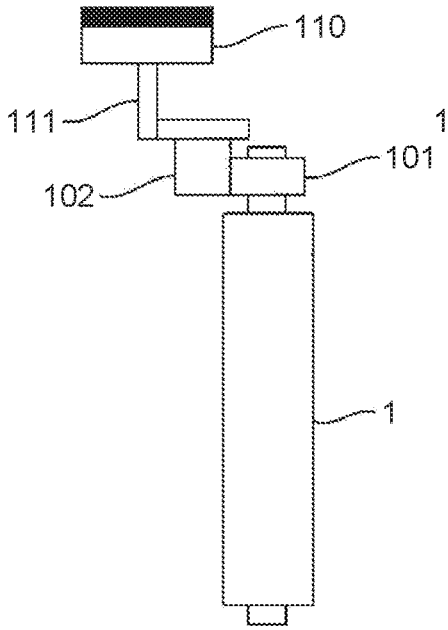

The configuration illustrated in FIG. 3B is a configuration where the motor of the motor unit 110 serves as a drive source and the motor gear 111 and the photoconductor gear 101 are connected via an idler gear 102 to drive the photoconductor 1 to rotate.

Figure 3C:
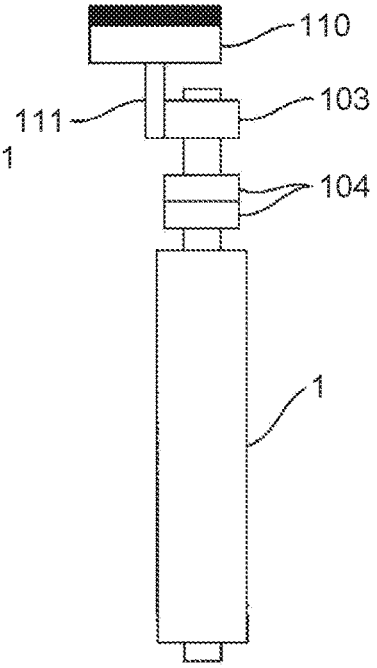

The configuration illustrated in FIG. 3C is a configuration where the motor of the motor unit 110 serves as a drive source, a gear 103 that is provided on one of joints 104 is connected to the motor gear 111, and the other joint 104 is provided on the rotation shaft of the photoconductor 1 to drive the photoconductor 1 to rotate via the joint 104.

Figure 3D:
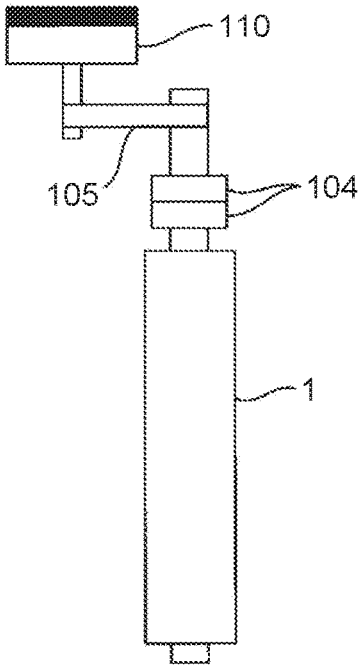

The configuration illustrated in FIG. 3D is a configuration where the motor of the motor unit 110 serves as a drive source and one of the joints 104 and the rotation shaft of the motor are connected by a timing belt 105 and the other joint 104 is provided on the rotation shaft of the photoconductor 1 to drive the photoconductor 1 to rotate via the joint 104.

Figure 3E:
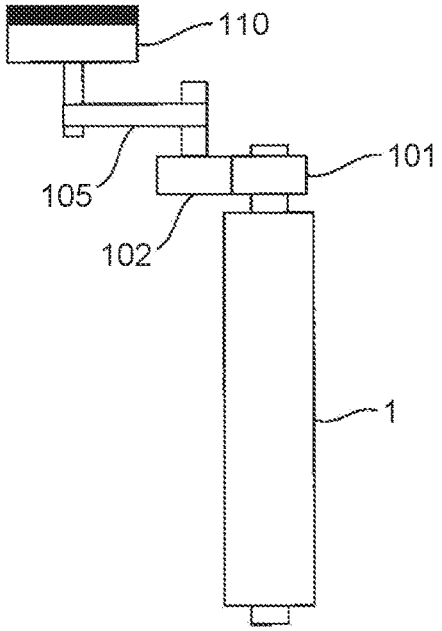

The configuration illustrated in FIG. 3E is a configuration where the motor of the motor unit 110 serves as a drive source and the rotation shaft of the idler gear 102 and the rotation shaft of the motor are connected by the timing belt 105 and the idler gear 102 is connected to the photoconductor gear 101 to drive the photoconductor 1 to rotate.

The exemplary configurations exemplified in FIGS. 3A to 3E are configurations to drive the photoconductor 1 by the motor via drive transmission members, such as a gear and joints. The drive transmission members include a backlash (clearance) that occurs in the interlocked parts of gears and a clearance that occurs in a connected part between joints. The embodiment employs the exemplary configuration illustrated in FIG. 3C.

Figure 4:
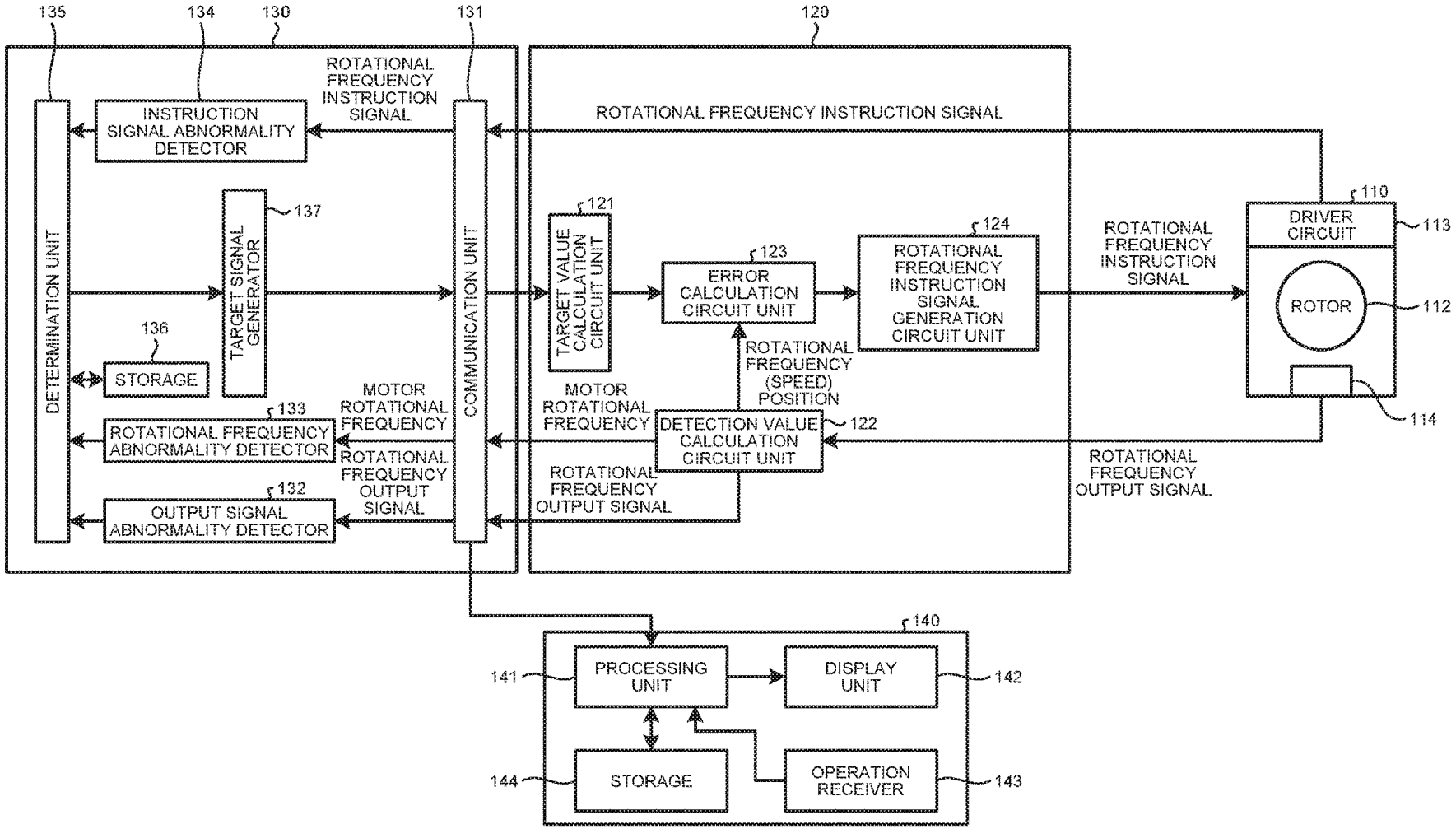
FIG. 4 is a block diagram of a configuration of a main unit controller and an abnormality detection device and of a motor control device and a motor unit that form a drive unit.

FIG. 4 is a block diagram illustrating configurations of the main unit controller 140, an abnormality detection device 130 and a motor control device 120 and the motor unit 110 that form a drive unit.

The main unit controller 140 controls the entire image forming apparatus and mainly includes, as components involved in abnormality detection of the embodiment, a processing unit 141 serving as a processing unit, a display unit 142 that is a display unit serving as a notification unit, an operation receiver 143 serving as an operation receiving unit, and a storage 144 serving as a storage unit. The processing unit 141 performs a process to cause the storage 144 to store the content of abnormality when the abnormality detection device 130 detects the abnormality and performs a process in which the operation receiver 143 receives a predetermined operation from an operator and thus the content of the abnormality corresponding to the predetermined operation is read from the storage 144 and the display unit 142 is caused to display the content. The display unit 142 and the operation receiver 143 are formed of an operation panel of the image forming apparatus main unit.

The abnormality detection device 130 mainly includes a communication unit 131, an output signal abnormality detector 132, a rotational frequency abnormality detector 133, an instruction signal abnormality detector 134, a determination unit 135, a storage 136 and a target signal generator 137. In the embodiment, the output signal abnormality detector 132, the rotational frequency abnormality detector 133, the instruction signal abnormality detector 134 and the determination unit 135 mainly form a determining unit. The hardware of the abnormality detection device 130 is a computer device mainly formed of a CPU, a ROM, a RAM, a communication I/F, etc. The CPU executes the process of and control on each of the above-described components by executing various programs that are stored in the ROM. The ROM stores the various programs for the CPU to execute various types of processes and control. The RAM is used as a work area of the CPU or functions as the aforementioned storage 136. The communication I/F forms the communication unit 131 and communicates with external devices, such as the main unit controller 140 and the motor control device 120.

The motor control device 120 performs drive control on the motor of the motor unit 110 by performing feedback control and the hardware of the motor control device 120 is formed by circuits. The motor control device 120 mainly includes a target value calculation circuit unit 121, a detection value calculation circuit unit 122, an error calculation circuit unit 123, and a rotational frequency instruction signal generator 124.

The target value calculation circuit unit 121 receives target signals (rotation direction signal and move pulse number signal) that are transmitted from the abnormality detection device 130 and calculates a target rotational position and a target rotational frequency (speed) from the time information of an oscillator. The result of the calculation is output to the error calculation circuit unit 123.

The detection value calculation circuit unit 122 calculates a rotational position of the motor and a rotational frequency (speed) of the motor from the rotational frequency output signal (frequency generator (FG) signal) that is output from the motor unit 110. The result of the calculation is output to the error calculation circuit unit 123 and the abnormality detection device 130. The detection value calculation circuit unit 122 also outputs the rotational frequency output signal that is output from the motor unit 110 to the abnormality detection device 130 together with the result of calculating the motor rotation position and the motor rotational frequency (speed).

The error calculation circuit unit 123 calculates a position error by calculating a difference between the target rotational position that is input from the target value calculation circuit unit 121 and the motor rotation position that is input from the detection value calculation circuit unit 122. The error calculation circuit unit 123 calculates a rotational frequency error by calculating a difference between the target rotational frequency (speed) that is input from the target value calculation circuit unit 121 and the motor rotational frequency (speed) that is input from the detection value calculation circuit unit 122. The result of the calculation is output to the rotational frequency instruction signal generator 124.

The rotational frequency instruction signal generator 124 generates a rotational frequency instruction signal as a motor drive instruction signal that enables the motor rotation position to approximate the target rotational position and enables the motor rotational frequency (speed) to approximate to the target rotational frequency (speed). The generated rotational frequency instruction signal is output to the motor unit 110.

The motor unit 110 mainly includes a motor 112 including a rotor, a driver circuit 113, and an FG signal output unit 114. The motor 112 of the embodiment is a DC motor. Alternatively, another motor, such as a pulse motor, may be used. When the driver circuit 113 receives the rotational frequency instruction signal that is output from the rotational frequency instruction signal generator 124 of the motor control device 120, the driver circuit 113 controls the drive current and the drive voltage that are input to the motor 112 according to the rotational frequency instruction signal. The driver circuit 113 outputs the rotational frequency instruction signal, which is received from the rotational frequency instruction signal generator 124 of the motor control device 120, to the abnormality detection device 130 via the motor control device 120. The FG signal output unit 114 outputs the FG signal representing the rotational frequency of the motor 112 as a rotational frequency output signal to the detection value calculation circuit unit 122 of the motor control device 120.

Figure 5:
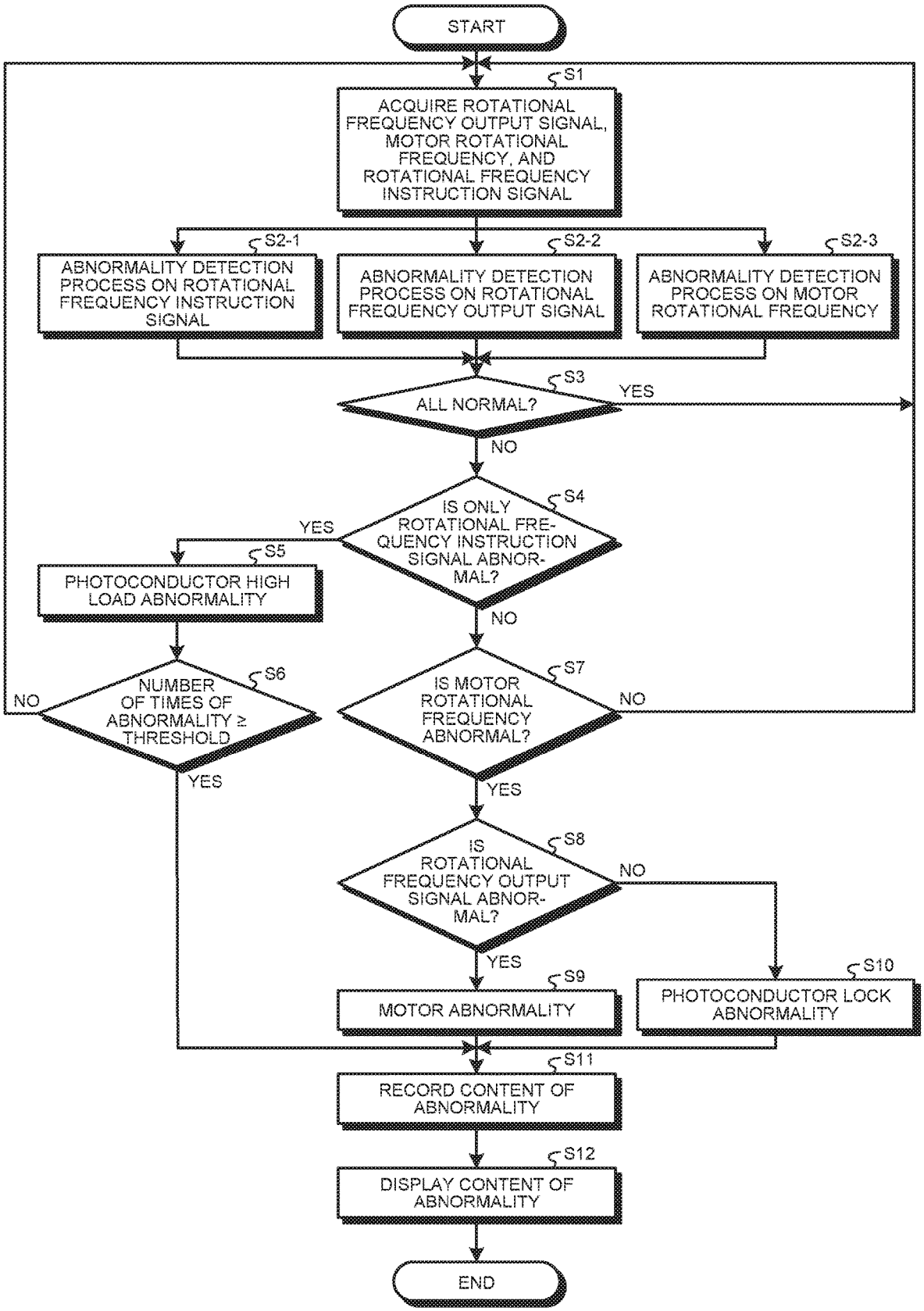
FIG. 5 is a flowchart of a flow of a process performed by the abnormality detection device in the embodiment.

FIG. 5 is a flowchart of a flow of a process performed by the abnormality detection device 130 in the embodiment.

When the motor 112 starts, the start triggers acquisition of a plurality of signals on driving the motor 112. Specifically, the communication unit 131 of the abnormality detection device 130 acquires a motor rotational frequency and a rotational frequency output signal (FG signal) that are output from the detection value calculation circuit unit 122 of the motor control device 120 and acquires a rotational frequency instruction signal that is output from the driver circuit 113 of the motor unit 110 (S1). In the embodiment, for each of the rotational frequency instruction signal, the rotational frequency output signal and the motor rotational frequency that are acquired, the abnormality detection process is started at constant sets of detection timing $t_1$, $t_2$, $t_3$, . . . that are repeated at predetermined time intervals (S2-1 to S2-3).

In the abnormality detection device 130 of the embodiment, the rotational frequency instruction signal that is acquired by the communication unit 131 is input to the instruction signal abnormality detector 134 and the instruction signal abnormality detector 134 performs the abnormality detection process to detect abnormality in the rotational frequency instruction signal (S2-1). The rotational frequency instruction signal in the embodiment is a PWM signal that represents a target rotational position by the rise timing of the repetition pulse signal and represents a target rotational frequency (speed) by duty cycle. Thus, when the motor rotation position is behind the target rotational position or the motor rotational frequency (speed) is behind the target rotational frequency (speed), the rotational frequency instruction signal generator 124 generates a rotational frequency instruction signal to increase the duty cycle to increase the pulse width, thereby enabling the motor rotation position to approximate to the target rotational position, or enabling the motor rotational frequency (speed) to approximate to the target rotational frequency (speed). Thus, when a high load exceeding a range of load that can be caused by normal operations is applied to the middle of the photoconductor 1 or a drive transmission member, the rotational load applied to the motor 112 increases and thus the motor rotation position may be behind the target rotational position or the motor rotational frequency (speed) may be behind the target rotational frequency (speed). As a result, the duty cycle of the rotational frequency instruction signal increases.

Figure 6:
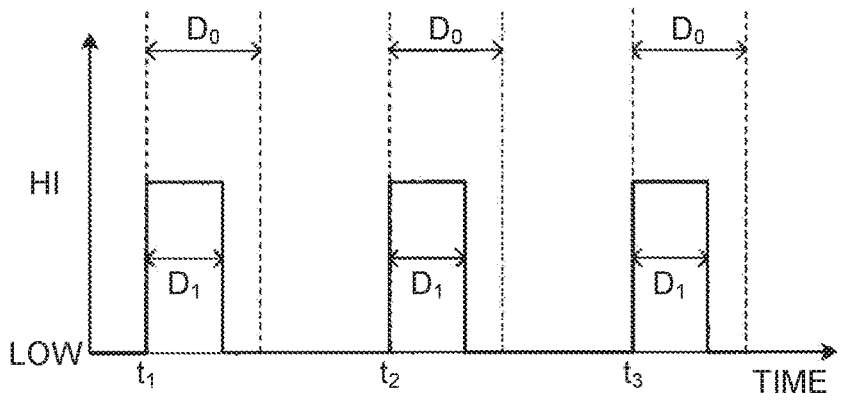
FIG. 6 is a graph representing a relation between a normal rotational frequency instruction signal and a threshold.

In the embodiment, as illustrated in FIG. 6, in order to distinguish loads within the range that can be caused by normal operations and loads exceeding the range, a threshold $D_0$ of the duty cycle is set. In the abnormality detection process on the rotational frequency instruction signal that is performed by the instruction signal abnormality detector 134, each time detection timing comes, it is determined that the rotational instruction signal is normal when the duty cycle $D_1$ of the input rotational frequency instruction signal is at or under the threshold $D_0$ and it is determined that the rotational instruction signal is abnormal when the duty cycle $D_1$ exceeds the threshold $D_0$, thereby detecting abnormality in the rotational frequency instruction signal.

In the embodiment, the pulse rise timing of the rotational frequency instruction signal triggers determination of the sets of detection timing $t_1$, $t_2$, $t_3$, . . . ; however, the determination is not limited thereto. In the embodiment, as illustrated in FIG. 6, the abnormality detection process on the rotational frequency instruction signal is performed on each of the pulses; however, when a plurality of pulses are input between sets of detection timing, for example, the abnormality detection process on the rotational frequency instruction signal may be performed on every second or third pulse. For example, the abnormality detection process on the rotational frequency detection signal may be performed on only pulses each of which is input right after detection timing comes.

In the abnormality detection device 130 of the embodiment, the rotational frequency output signal that is acquired by the communication unit 131 is input to the output signal abnormality detector 132 and the output signal abnormality detector 132 performs the abnormality detection process to detect abnormality in the rotational frequency output signal (S2-2). The rotational frequency output signal in the embodiment is an FG signal that is output from the FG signal output unit 114 of the motor unit 110 and is formed of a repetitive pulse signal of a frequency corresponding to the rotational frequency of the motor 112. Thus, when the motor 112 can be driven following the target rotational frequency (speed) that is represented by the rotational frequency instruction signal, a repetitive pulse signal of the frequency representing the rotational frequency equivalent to the target rotational frequency is input as the rotational frequency output signal to the output signal abnormality detector 132. Accordingly, even in a condition where a high load exceeding loads within the range that can be caused by normal operations is being applied, when the motor 112 can be driven following the target rotational frequency (speed) that is represented by the rotational frequency instruction signal, a repetitive pulse signal of a frequency representing a rotational frequency equivalent to the target rotational frequency is input as the rotational frequency output signal to the output signal abnormality detector 132.

Figure 7:
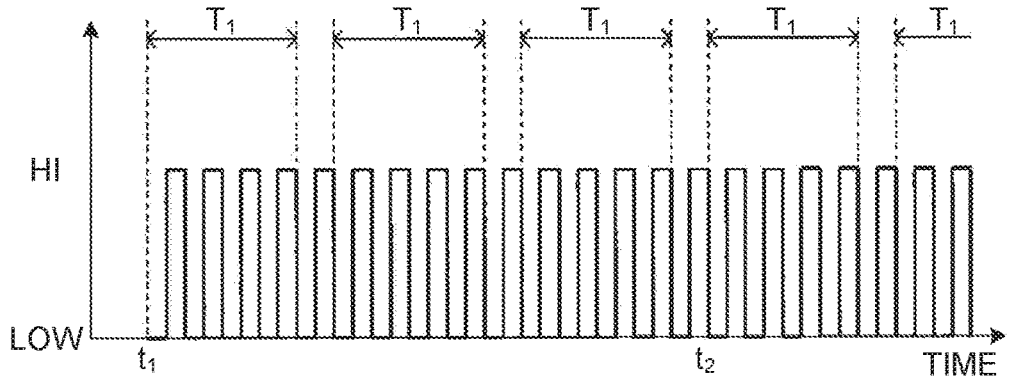
FIG. 7 is a graph representing a relation between a normal rotational frequency output signal and determination times.

In the embodiment, in the abnormality detection process on the rotational frequency output signal that is performed by the output signal abnormality detector 132, as illustrated in FIG. 7, when the number of pulses of the rotational frequency output signal that are input within a preliminarily determined determination time T1 is above a predetermined threshold N3, it is determined that the rotational frequency instruction signal is normal and, when the number of pulses is at or under the threshold, it is determined that the rotational frequency instruction signal is abnormal. In the embodiment, as illustrated in FIG. 7, three determination times T1 are contained between the sets of detection timing (between t3 and t4) and thus, as for the rotational frequency output signal, three determination results are obtained for one set of detection timing. In the embodiment, when it is determined that each of the three determination results is normal, it is determined that the rotational frequency output signal is not abnormal (is normal) and, when it is determined that any one of the three determination results is abnormal, it is determined that the rotational frequency output signal is abnormal. In this manner, abnormality in the rotational frequency output signal is detected.

In the abnormality detection device 130, the motor rotational frequency that is acquired by the communication unit 131 is input to the rotational frequency abnormality detector 133 and the rotational frequency abnormality detector 133 performs the abnormality detection process to detect abnormality in the motor rotational frequency (S2-3). The motor rotational frequency in the embodiment is the rotational frequency of the motor 112 that is calculated by the detection value calculation circuit unit 122 of the motor control device 120 based on the rotational frequency output signal. Thus, when the motor 112 can be driven following the target rotational frequency (speed) that is represented by the rotational frequency instruction signal, a rotational frequency equivalent to the target rotational frequency is input to the rotational frequency abnormality detector 133. Thus, even in a condition where a high load exceeding loads within the range that can be caused by normal operations is applied, when the motor 112 can be driven following the target rotational frequency (speed) represented by the rotational frequency instruction signal, a rotational frequency equivalent to the target rotational frequency is input to the rotational frequency abnormality detector 133.

Figure 8:
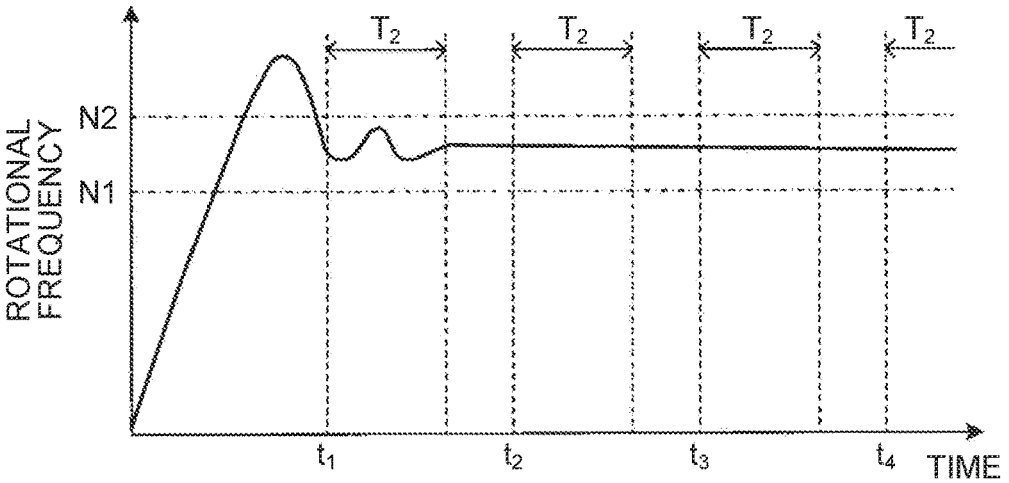
FIG. 8 is a graph representing a relation between a normal motor rotational frequency, a threshold, and determination times.

In the embodiment, in the abnormality detection process on the motor rotational frequency that is performed by the rotational frequency abnormality detector 133, as illustrated in FIG. 8, when the motor rotational frequency that is input is between a predetermined lower limit threshold N1 and a predetermined upper limit threshold N2, it is determined that the motor rotational frequency is normal and, when the motor rotational frequency that is input is not between the lower limit threshold N1 and the upper limit threshold N2, it is determined that the motor rotational frequency is abnormal and abnormality in the motor rotational frequency is detected. The embodiment is an example where, as illustrated in FIG. 8, one determination time T2 is contained between sets of detection timing. Alternatively, multiple determination times T2 may be contained between the sets of detection timing. When a plurality of determination times T2 are contained between sets of detection timing, for example, when it is determined in any of the determination times that the motor rotational frequency is normal, it is determined that the motor rotational frequency is not abnormal (normal) and, when it is determined on any one of the determination times that the motor rotational frequency is abnormal, it is determined that the motor rotational frequency is abnormal. In this manner, abnormality in the motor rotational frequency may be detected.

The detection results of the three types of abnormality detection processes performed as described above are output to the determination unit 135. The determination unit 135 performs a determination process to determine the content of abnormality distinctively as represented in Table 1 below according to the combination of the detection results of the abnormality detection processes.

TABLE 1

| Condition | Rotational Frequency Abnormality | Rotational Frequency Output Signal Abnormality | Rotational Frequency Instruction Signal Abnormality | Determination | |
|---|---|---|---|---|---|
| Normal | Undetected | Undetected | Undetected | Normal | |
| Abnormal | Undetected | Undetected | Detected | Photoconductor Abnormality | Photoconductor High Load Abnormality |
| | Detected | Undetected | Detected | | Photoconductor Lock Abnormality |
| | Detected | Detected | Detected | Motor Abnormality | |

In the determination process, when it is not determined that it is abnormal in all the abnormality detection processes, that is, when it is determined that it it determined in all the abnormality detection processes that it is normal (YES at S3), as illustrated in Table 1, the determination unit 135 determines that it is "normal".

On the other hand, in the embodiment, the determination unit 135 distinctively determines abnormality in the photoconductor 1 or the transmission members ("photoconductor abnormality" below) and abnormality in the motor unit 110 ("motor abnormality" below).

The "photoconductor abnormality" refers to abnormality that occurs on a downstream side with respect to the motor unit 110 on the drive transmission route in which a drive force is transmitted from the motor unit 110 to the photoconductor 1 via the drive transmission members. Specific examples are, for example, a condition where a high load is applied from outside to the photoconductor 1 and a condition where a foreign matter goes into the gear, the joint or the like in the drive transmission route between the photoconductor 1 and the drive transmission members and abrasion progresses and thus the drive transmission is hindered and the photoconductor is not driven normally.

The "motor abnormality" herein refers to abnormality that occurs on an upstream side with respect to the drive transmission members on the drive transmission route. Specific examples are, for example, a condition where the motor 112 of the motor unit 110 fails (a failure in the rotor), a condition where the motor 112 rotates normally but no rotational frequency output signal is output (a failure of the FG signal output unit 114, or the like), a condition where no drive current and no drive voltage is input from the driver circuit 113 to the motor 112 (a failure of the driver circuit 113 etc.).

Furthermore, in the embodiment, the "photoconductor abnormality" is determined further distinctively according to the content of the two types of abnormality. The two types of abnormality are "photoconductor high load abnormality" representing a condition where a load higher than normal one is applied to the photoconductor 1 or the drive transmission member within a range where the motor 112 can be driven following the target rotational frequency (speed) and "photoconductor lock abnormality" representing a condition where a high load is applied to the photoconductor 1 or the drive transmission member so that the motor 112 cannot be driven following the target rotational frequency (speed).

The "photoconductor high load abnormality" refers to a condition where the coefficient of friction between the cleaning blade that contacts the photoconductor 1, or the like, and the surface of the photoconductor abnormally increases or a foreign matter goes into the gear or the joint of the drive transmission members and abrasion progress and thus a high load is applied to rotation of the photoconductor 1.

The "photoconductor lock abnormality" refers to a condition where the cleaning blade that contacts the photoconductor 1 twists or a foreign matter goes into the gear or the joint of the drive transmission members or damaged and thus rotation of the photoconductor 1 is locked or a condition where a super high load is applied such that the rotational frequency (speed) of the photoconductor 1 cannot be maintained within a normal range.

Figure 9:
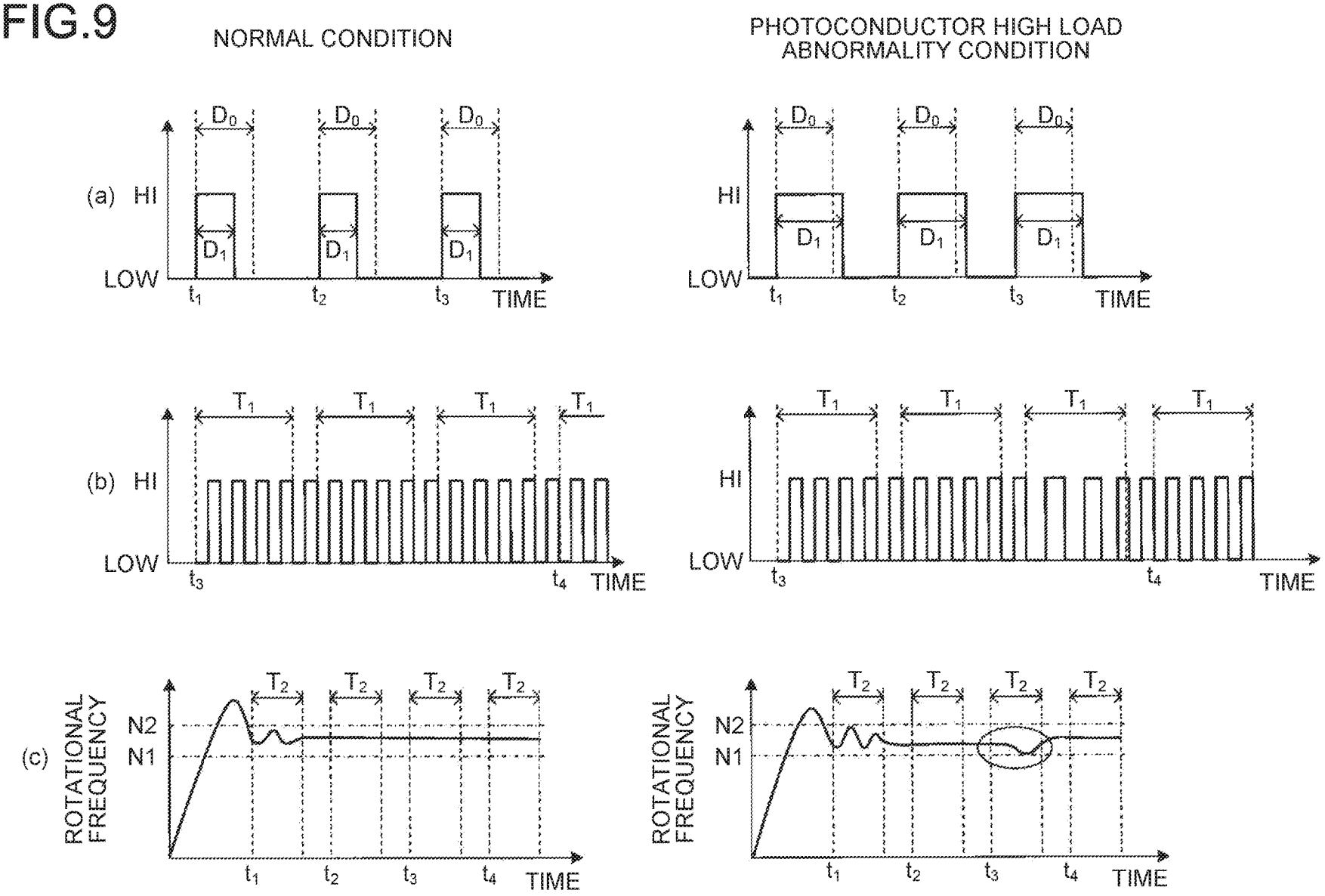
FIG. 9 is a graph of rotational frequency instruction signals, rotational frequency output signals, motor rotational frequencies in a normal condition and in a photoconductor high load abnormality condition.

FIG. 9 is a graph representing rotational frequency instruction signals, rotational frequency output signals and motor rotational frequencies in the normal condition and the photoconductor high load abnormality condition.

In the embodiment, as for combinations of abnormality detection results of the rotational frequency output signal, the motor rotational frequency and the rotational frequency instruction signal that are input to the determination unit 135, when only the rotational frequency instruction signal is abnormal (YES at S4), as represented at (a) and (c) in FIG. 9, the rotational frequency output signal and the motor rotational frequency are normal and thus the motor 112 can be driven following the target rotational frequency (speed). As represented at (a) in FIG. 9, however, the rotational frequency instruction signal is abnormal and thus it can be assumed that a load higher than a normal load is applied to the photoconductor 1 or the drive transmission member. Thus, in this case, as represented in Table 1, the determination unit 135 determines that it is the "photoconductor high load abnormality" of the "photoconductor abnormality" (S5).

The determination unit 135 counts up the number of times of photoconductor high load abnormality representing the number of times for which the "photoconductor high load abnormality" is determined and, when the number of times of abnormality is at or above a threshold n1 (YES at step S6), stores the fact that the "photoconductor high load abnormality" occurs in the storage 136 (S11). The determination unit 135 outputs the fact that that the "photoconductor high-load abnormality" occurs from the communication unit 131 to the main unit controller 140. Accordingly, the processing unit 141 of the main unit controller 140 also stores the fact that the "photoconductor high-load abnormality" occurs in the storage 144 (S11). Furthermore, the processing unit 141 causes the display unit 142 to display the fact that the "photoconductor high load abnormality" occurs (S12). As a result, it is possible to notify the user, or the like, of the fact that the "photoconductor high load abnormality" occurs. Instead of the fact that the "photoconductor high load abnormality" occurs, the user, or the like, may be notified of an alert to let the user, or the like, expect or know the failure.

Figure 10:
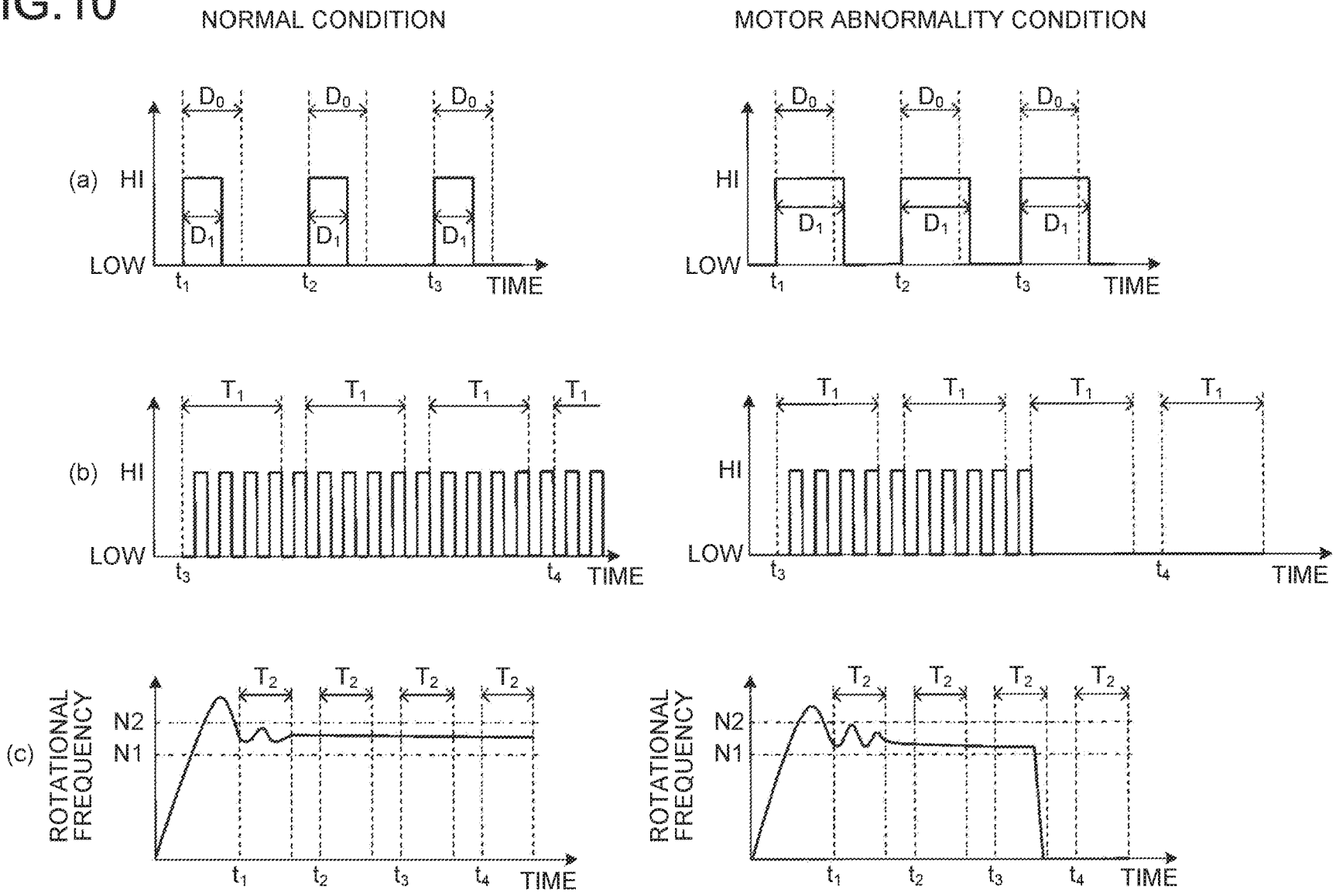
FIG. 10 is a graph of rotational frequency instruction signals, rotational frequency output signals, motor rotational frequencies in a normal condition and in a motor abnormality condition.

FIG. 10 is a graph representing rotational frequency instruction signals, rotational frequency output signals and motor rational frequencies in a normal condition and a motor abnormal condition.

When a motor abnormality occurs at a time point after the detection timing t3 and before the detection timing t4, abnormalities are detected in all the abnormality detection processes on the rotational frequency instruction signal, the rotational frequency output signal, and the motor rotational frequency at the detection timing t3. Specifically, when a motor abnormality occurs, the duty cycle of the rotational frequency instruction signal tends to increase at a stage just before the occurrence of the motor abnormality in order for the motor rotational frequency to follow the target rotational frequency and, as illustrated at (a) in FIG. 10, abnormality in the rotational frequency instruction signal is detected at and after the detection timing t1.

On the other hand, when a motor abnormality occurs, output of pulses of the rotational frequency output signal suddenly stops right after the occurrence of abnormality and accordingly, as represented at (b) in FIG. 10, it is determined that the rotational frequency output signal is abnormal in the determination time (the third determination time in the detection timing t3) right after the occurrence of motor abnormality in the detection timing t3. Accordingly, at the detection timing t3, it is determined that the rotational frequency output signal is abnormal.

On the other hand, as represented at (c) in FIG. 10, the motor rotational frequency that is calculated from the rotational frequency output signal abruptly declines and the motor rotational frequency is under the threshold N1 during the determination time of the detection timing t3. Accordingly, at the detection timing t3, it is detected that the motor rotational frequency is abnormal.

As described above, when a motor abnormality occurs, in the embodiment, it is detected at the same detection timing that both the rotational frequency output signal and the motor rotational frequency are abnormal. Accordingly, in the embodiment, when abnormalities are detected in all the rotational frequency instruction signal, the rotational frequency output signal and the motor rotational frequency (NO at S3, NO at S4, YES at S7 and YES at S8), as represented in Table 1, the determination unit 135 determines that it is the "motor abnormality" (S9). The determination unit 135 then stores the fact that the "motor abnormality" occurs in the storage 136 (S11). The determination unit 135 outputs the fact that the "motor abnormality" occurs from the communication unit 131 to the main unit controller 140. Accordingly, also in the processing unit 141 of the main unit controller 140, the fact that the "motor abnormality" occurs is stored in the storage 144 (S11). Furthermore, the processing unit 141 causes the display unit 142 to display the fact that the "motor abnormality" occurs (S12). As a result, the user, or the like, can be notified of the fact that the "motor abnormality" occurs. Instead of the fact that the "motor abnormality" occurs, the user, or the like, may be notified of an alert to let the user, or the like, expect or know the failure.

Figure 11:
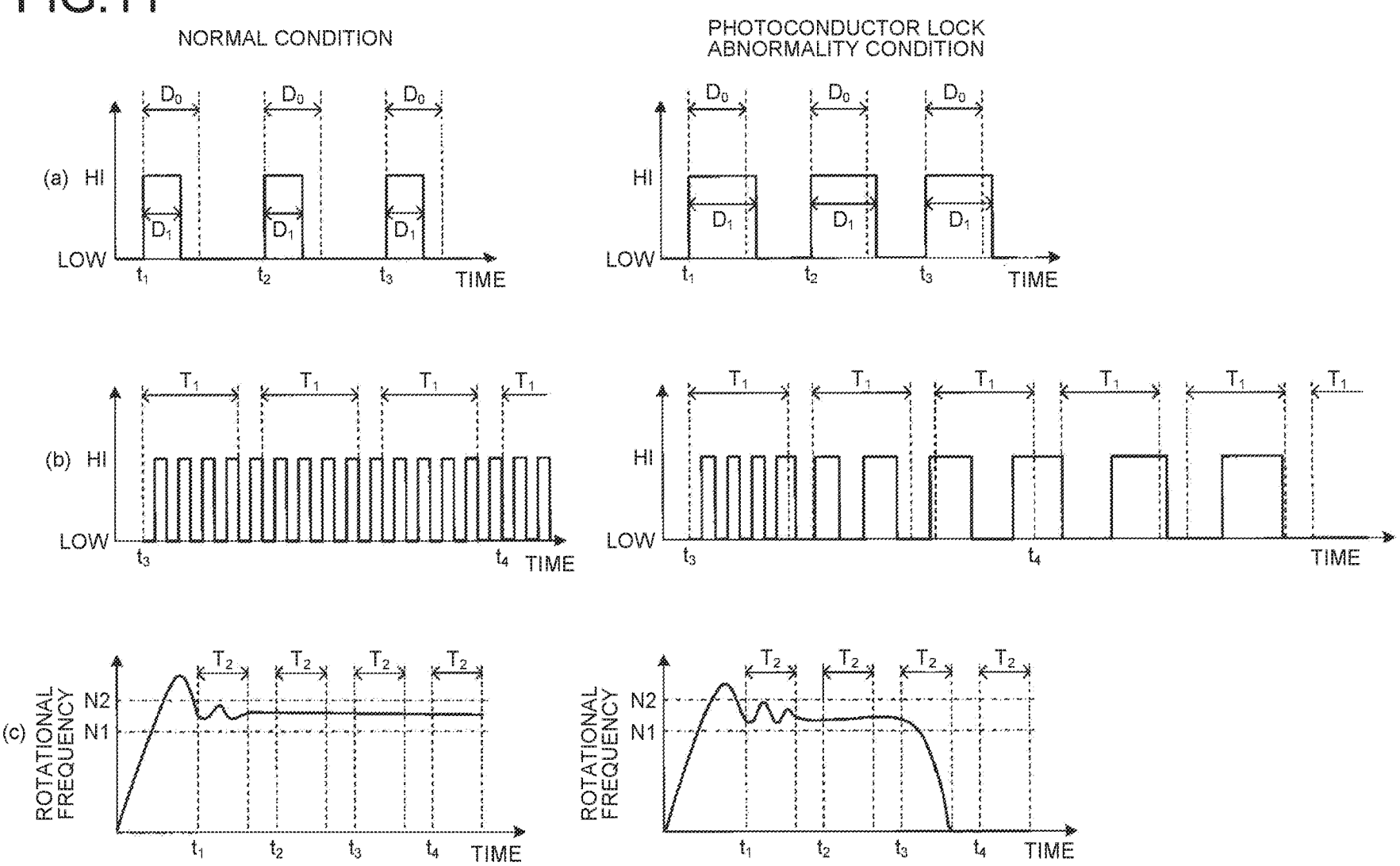
FIG. 11 is a graph of rotational frequency instruction signals, rotational frequency output signals, motor rotational frequencies in a normal condition and in a photoconductor lock abnormality condition.

FIG. 11 is a graph of rotational frequency instruction signals, rotational frequency output signals and motor rotational frequencies in a normal condition and a photoconductor lock abnormality condition.

When a photoconductor lock abnormality occurs at a time point after the detection timing t3 and before the detection timing t4, as represented at (a) and (c) in FIG. 11, at the detection timing t3, it is detected that the motor rotational frequency is abnormal but it is detected that the rotational frequency output signal is normal because of the following reasons.

When the photoconductor lock abnormality occurs, the duty cycle of the rotational frequency instruction signal increases in order for the motor rotational frequency to follow the target rotational frequency and, as represented at (a) in FIG. 11, abnormality is detected in the rotational frequency instruction signal. When the photoconductor lock abnormality occurs, there is the condition where a super high load is applied so that the motor rotational frequency cannot follow the target rotational frequency or the condition where the rotation is stopped (locked) and thus, as represented at (b) in FIG. 11, the number of pulses of the rotational frequency output signal decreases right after the photoconductive lock abnormality occurs (the frequency of the rotational frequency output signal starts lowering). As a result, the motor rotational frequency that is calculated from the rotational frequency output signal drops and, as represented at (c) in FIG. 11, the motor rotational frequency is under the threshold N1 during the determination time of the detection timing t3 and thus it is detected that the motor rotational frequency is abnormal at the detection timing t3.

As for the rotational frequency output signal, while the number of pulses decreases, the pulses exceeding the predetermined threshold N3 in number are kept input for a while and pulses exceeding the predetermined threshold N3 in number is input at any of the three determination times contained in the detection timing t3. Thus, at the detection timing t3, it is determined that the rotational frequency output signal is normal.

This is because, even when the photoconductor 1 is locked (stops), the motor 112 keeps rotating until the clearance (allowance), such as the backlash, present in the gear or the joint of the drive transmission members is buried and, even when the gap is buried, pulses are kept output until the rotation of the motor stops. Accordingly, abnormality is detected in the rotational frequency output signal behind the time when abnormality in the motor rotational frequency is detected. In other words, in the photoconductor lock abnormality, the time difference between the time when the abnormality of the motor rotational frequency is detected and the time when it is detected that the rotational frequency output signal is abnormal is large (the time when it is detected that the rotational frequency output signal is abnormal is largely behind the time when the abnormality of the motor rotational frequency is detected).

The embodiment focuses on the aspect that, even when the photoconductor 1 is locked (stopped), pulses of the rotational frequency output signal are output for a while, and uses the aspect to determine the photoconductor lock abnormality distinctively from the motor abnormality.

In other words, also when the photoconductor lock abnormality occurs, abnormality in the rotational frequency output signal is detected at the detection timing t4 and thus abnormalities are detected in all the rotational frequency instruction signal, the rotational frequency output signal, and the motor rotational frequency. Thus, when determination is made based on the combination of the detection results at this time point, the photoconductor lock abnormality is based on the same combination as that on which the motor abnormality is based and thus it is not possible to determine the photoconductor lock abnormality and the motor abnormality distinctively. As described above, when the photoconductor lock abnormality occurs, however, there is a difference in that there is a large time difference between the time when the abnormality in the rotational frequency output signal is detected and the time when the abnormality in the motor rotational frequency is detected. The embodiment uses the difference and, when the abnormality in the motor rotational frequency is detected (YES at S7), when no abnormality is detected in the rotational frequency output signal (NO at S8), even when abnormalities are detected later in both the motor rotational frequency and the rotational frequency output signal, not the "motor abnormality" but the "photoconductor lock abnormality" is determined (S10).

Specifically, in the embodiment, when abnormalities in only the rotational frequency instruction signal and the motor rotational frequency are detected (when no abnormality in the rotational frequency output signal is detected) (NO at S4, YES at S7, and NO at S8), as represented in Table 1, the determination unit 135 determines that it is the "photoconductor lock abnormality" (S10). The determination unit 135 then stores the fact that the "photoconductor lock abnormality" occurs in the storage 136 (S11). The determination unit 135 outputs the fact that the "photoconductor lock abnormality" occurs to the main unit controller 140. Accordingly, the processing unit 141 of the main unit controller 140 also stores the fact that the "photoconductor lock abnormality" occurs in the storage 144 (S11). The processing unit 141 further causes the display unit 142 to display the fact that the "photoconductor lock abnormality" occurs (S12). As a result, it is possible to notify the user, or the like, of the fact that the "photoconductor lock abnormality" occurs. The user, or the like, may be notified of an alert instead of the fact that the "photoconductor lock abnormality" occurs to let the user, or the like, to expect or know the failure.

Even when a "motor abnormality" occurs, depending on setting of the determination times T1 and T2 and the thresholds N1 and N3, there may be a case where, due to a difference in the timing of occurrence of the motor abnormality, for example, when a motor abnormality occurs in the middle of the determination time T1 of the detection timing t3, no abnormality in the rotational frequency output signal is detected (the rotational frequency output signal is normal) at the time point when abnormality in the motor rotational frequency is detected (at the detection timing t3). Even in such a case, as described above, a "photoconductor lock abnormality" and a "motor abnormality" have a difference in the time difference between the timing at which abnormality in the rotational frequency output signal is detected and the timing at which abnormality in the motor rotational frequency is detected and thus, by, for example, delaying the determination timing (determining at the detection timing following the detection timing at which it is detected that the motor rotational frequency is abnormal), it is possible to determine a "photoconductor lock abnormality" and a "motor abnormality" distinctively Preferably, regardless of the timing of occurrence of a motor abnormality, when a "photoconductor lock abnormality" occurs, setting of the determination times T1 and T2, the thresholds N1 and N3, etc., is adjusted so as not to detect abnormality in the rotational frequency output signal at the time point when abnormality in the motor rotational frequency is detected. To do so, it is preferable to satisfy the following relation: the determination time T1 for the rotational frequency output signal ≤ the determination time T2 for the motor rotational frequency.

In the embodiment, there are three types of abnormality: photoconductor high load abnormality, photoconductor lock abnormality and motor abnormality. Two types of abnormality selected from the three types of abnormality may be determined distinctively or another type of abnormality may be added and at least four types of abnormality may be determined distinctively. When the two types of abnormality of photoconductor high load abnormality and photoconductor lock abnormality are determined distinctively, it suffices if abnormality in the rotational frequency instruction signal and any one of abnormality in the rotational frequency output signal and abnormality in the motor rotational frequency are detected. When two types of abnormality of photoconductor high load abnormality and motor abnormality are determined distinctively, it is not necessarily required to detect abnormality in the rotational frequency instruction signal if abnormality in the rotational frequency output signal and abnormality in the motor rotational frequency are detected.

The above-described embodiment is an example and each of the following modes produces unique effects.

Mode A

The abnormality detection device 130 that detects abnormality in a subject to be driven (for example, the photoconductor 1) by the motor 112 via a drive transmission member (for example, the photoconductor gear 101, the idler gear 102, the joints 104, the timing belt 105 and the motor gear 111) includes an output signal acquisition unit (for example, the communication unit 131) that acquires a rotational frequency output signal (for example, an FG signal) that is output from the motor; a rotational frequency acquisition unit (for example, the communication unit 131) that acquires a motor rotational frequency that is calculated from the rotational frequency output signal that is acquired by the output signal acquisition unit; and a determining unit (for example, the determination unit 135) that distinctively determines abnormality in the subject to be driven and abnormality in the motor based on the rotational frequency output signal that is acquired by the output signal acquisition unit and the motor rotational frequency that is acquired by the rotational frequency acquisition unit.

A conventional device that distinctively determines abnormality in the motor and abnormality in the subject to be driven based on only the rotational frequency of the motor determines that the motor is in a faulty condition (the motor is abnormal) when the rotational frequency of the motor is under a predetermined threshold (the first threshold, or the like). Even in this case, however, the motor is not necessarily abnormal practically. For example, when a high load that locks (stops) driving the subject to be driven is applied to the subject to be driven, the rotational frequency of the motor is under the predetermined threshold. In such a case, the motor is not abnormal and determining that the motor is abnormal causes a problem in that, for example, the motor without any abnormality is replaced or replacing the motor does not improve the situation.

On whether it is abnormality in the motor or abnormality in the subject to be driven, the inventor focused on the rotational frequency output signal that is output from the motor from the study and obtained the following findings.

When abnormality in the motor occurs, an abnormal signal value in which the motor rotational frequency abruptly drops appears in the rotational frequency output signal that is output from the motor right after occurrence of the abnormality in the motor. This is because, when abnormality occurs in the motor that outputs the rotational frequency output signal, the rotational frequency output signal promptly reflects the abnormality. On the other hand, when abnormality in the subject to be driven occurs, a signal value in which the motor rotational frequency gradually reduces appears right after the occurrence of the abnormality in the subject to be driven and, after a while, an abnormal signal value is represented. This is because, even when a high load that locks (stops) driving the subject to be driven is applied to the subject to be driven, the clearance (allowance) in the drive transmission member, or the like, allows the motor to continue rotating slightly. The timing at which the rotational frequency abnormality detection unit detects abnormality in the motor rotational frequency is approximately the same between the case where abnormality in the motor occurs and the case where abnormality in the subject to be driven occurs.

According to the findings, it is possible to distinctively determine that, when the time difference between the time when abnormality in the motor rotational frequency is detected and the time when abnormality in the rotational frequency output signal is detected is large, the subject to be driven is abnormal and, when the time difference is small, the motor is abnormal. Thus, according to the embodiment, not only the motor rotational frequency that is acquired by the rotational frequency acquisition unit but also the rotational frequency output signal that is acquired by the output signal acquisition unit is used to determine whether it is abnormality in the subject to be driven or abnormality in the motor and thus it is possible to make the determination using the above-described difference in the time difference and properly determine abnormality in the subject to be driven that is conventionally falsely determined as abnormality in the motor distinctively from abnormality in the motor.

An "abnormality in the motor" herein refers to abnormality that occurs on the downstream side with respect to the motor in the drive transmission route. Specifically, for example, in addition to a condition where the subject to be driven fails, a condition where an abnormally high load is applied to the subject to be driven due to abnormality in a state of contact with the member contacting the subject to be driven, and a condition where drive transmission is hindered because, for example, a foreign matter goes into the drive transmission route between the subject to be driven and the drive transmission members and thus the subject to be driven is not driven normally.

Mode B

In Mode A, when it is determined for the first time that the motor rotational frequency that is acquired by the rotational frequency acquisition unit is abnormal, the determining unit determines that the motor is abnormal when the rotational output signal that is acquired by the output signal acquisition unit is abnormal and determines that the subject to be driven is abnormal when the rotational frequency output signal that is acquired by the output signal acquisition unit is not abnormal.

Thus, when abnormality in the motor rotational frequency is detected, it is possible to easily determine distinctively whether the abnormality in the motor rotational frequency results from abnormality in the motor or results from abnormality in the subject to be driven.

Mode C

In Mode A or B, a period (for example, the determination time T1) in which the output signal abnormality detection unit detects whether the rotational frequency output signal is abnormal is equal to or shorter than a period (for example, the determination time T2) in which the rotational frequency abnormality detection unit detects whether the motor rotational frequency is abnormal.

This enables easy adjustment to detect that the rotational frequency output signal is not abnormal when abnormality in the subject to be driven occurs and it is detected that the motor rotational frequency is abnormal. As a result, when abnormality in the motor rotational frequency is detected, it is possible to easily determine distinctively whether the abnormality of the motor rotational frequency results from abnormality in the motor or results from abnormality in the subject to be driven.

Mode D

In any one of Modes A to C, the motor is controlled by feedback control to bring the motor rotational frequency that is acquired by the rotational frequency acquisition unit, close to a target rotational frequency, the abnormality detection device further includes an instruction signal acquisition unit (for example, the communication unit 131) that acquires a motor drive instruction signal (for example, a rotational frequency instruction signal) that is generated by the feedback control, and the determining unit determines whether the subject to be driven has high-load abnormality based on the motor rotational frequency that is acquired by the rotational frequency acquisition unit and the motor drive instruction signal that is acquired by the instruction signal acquisition unit.

With the conventional device that determines abnormality based on only the rotational frequency of the motor, when the feedback control is performed on the motor, it is difficult to properly determine high-load abnormality. In other words, when feedback control is performed on the motor, even when high-load abnormality occurs, a motor drive instruction signal to bring the motor rotational frequency close to the target rotational frequency is generated and accordingly the motor rotational frequency is prevented from dropping. For this reason, the motor rotational frequency does not show abnormality even when high-load abnormality occurs and thus the conventional device that determines abnormality based on only the rotational frequency of the motor determines that it is not abnormal. The high-load abnormality herein is relatively a small abnormality with which it is possible to maintain the motor rotational frequency by feedback control; however, continuous occurrence of the high-load abnormality my lead to a failure and thus it is preferable that the high-load abnormality is determined as one type of abnormality in the subject to be driven.

The motor drive instruction signal that is generated when the high-load abnormality occurs serves as an instruction to drive the motor at a motor rotational frequency higher than that in a normal load condition. In Mode D, the instruction signal abnormality detection unit is able to detect abnormality when the motor drive instruction signal serves as an instruction to drive the motor at a motor rotational frequency higher than that in the normal load condition. In Mode D, not only the motor rotational frequency that is acquired by the rotational frequency acquisition unit but also the rotational frequency output signal that is acquired by the output signal acquisition unit is used and thus, even in a condition where abnormality in the motor rotational frequency is not detected, when abnormality in the motor drive instruction signal is detected, it is possible to determine that the subject to be driven has high-load abnormality. Accordingly, it is possible to properly determine the high-load abnormality in the subject to be driven that is conventionally determined as being normal.

Mode E

The abnormality detection device 130 that detects that a subject to be driven (for example, the photoconductor 1) by the motor 112 that is controlled by feedback control to bring a motor rotational frequency close to a target rotational frequency has high-load abnormality includes a rotational frequency acquisition unit (for example, the communication unit 131) that acquires the motor rotational frequency of the motor; an instruction signal acquisition unit (for example, the communication unit 131) that acquires a motor drive instruction signal (for example, a rotational frequency instruction signal) that is generated by the feedback control; and a determining unit (for example, the determination unit 135) that determines whether the subject to be driven has high-load abnormality based on the motor rotational frequency that is acquired by the rotational frequency acquisition unit and the motor drive instruction signal that is acquired by the instruction signal acquisition unit.

With the conventional device that determines abnormality based on only the rotational frequency of the motor, when the feedback control is performed on the motor, it is difficult to properly determine high-load abnormality. In other words, when feedback control is performed on the motor, even when high-load abnormality occurs, a motor drive instruction signal to bring the motor rotational frequency close to the target rotational frequency is generated and accordingly the motor rotational frequency is prevented from dropping. For this reason, the motor rotational frequency does not show abnormality even when high-load abnormality occurs and thus the conventional device that determines abnormality based on only the rotational frequency of the motor determines that it is not abnormal. The high-load abnormality herein is relatively a small abnormality with which it is possible to maintain the motor rotational frequency by feedback control; however, continuous occurrence of the high-load abnormality my lead to a failure and thus it is preferable that the high-load abnormality is determined as one type of abnormality in the subject to be driven.

The motor drive instruction signal that is generated when the high-load abnormality occurs serves as an instruction to drive the motor at a motor rotational frequency higher than that in a normal load condition. In Mode D, the instruction signal abnormality detection unit is able to detect abnormality when the motor drive instruction signal serves as an instruction to drive the motor at a motor rotational frequency higher than that in the normal load condition. In Mode D, not only the motor rotational frequency that is acquired by the rotational frequency acquisition unit but also the rotational frequency output signal that is acquired by the output signal acquisition unit is used and thus, even in a condition where abnormality in the motor rotational frequency is not detected, when abnormality in the motor drive instruction signal is detected, it is possible to determine that the subject to be driven has high-load abnormality. Accordingly, it is possible to properly determine the high-load abnormality in the subject to be driven that is conventionally determined as being normal.

Mode F

In Mode D or E, when it is determined that the motor rotational frequency that is acquired by the rotational frequency acquisition unit is not abnormal, the determining unit determines that the subject to be driven has the high load abnormality when the motor drive instruction signal that is acquired by the instruction signal acquisition unit is abnormal, and determines that the subject to be driven does not have the high load abnormality when the motor drive instruction signal that is acquired by the instruction signal acquisition unit is not abnormal.

Accordingly, it is possible to determine whether the subject to be driven has the high load abnormality even when any abnormality in the motor rotational frequency is not detected.

Mode G

An image forming apparatus with an object to be driven by the motor 112 (for example, the photoconductor 1) includes an abnormality detection unit that detects an abnormality in the object to be driven, wherein the abnormality detection device 130 according to any one of Modes A to F is used as the abnormality detection unit.

Accordingly, it is possible to realize an image forming apparatus capable of properly determining abnormality in the subject to be driven.

Mode H

In Mode G, the image forming apparatus further includes a notification unit (for example, the display unit 142) that, when the abnormality detection device detects abnormality, makes a notification of occurrence of the abnormality.

Accordingly, it is possible to notify the user, or the like, of the occurrence of the abnormality and promptly deal with the abnormality.

Mode I

In Mode G or H, the image forming apparatus further includes a storage unit (for example, the storage 144) that stores content of abnormality, a display unit (for example, the display unit 142) that displays the content of the abnormality, an operation reception unit (for example, the operation receiver 143) that receives an operation, and a processing unit (for example, the processing unit 141) that performs a process to, when the abnormality detection device detects abnormality, cause the storage unit to store content of the abnormality and a process to, in response to reception of a predetermined operation by the operation reception unit, read the content of the abnormality corresponding to the predetermined operation from the storage unit and cause the display unit to display the content of the abnormality.

Accordingly, it is possible to inform the user, or the like, of the content of the abnormality that has occurred according to a request from the user, or the like.

According to an embodiment, an excellent effect that it is possible to properly determine abnormality in a subject to be driven that is conventionally determined falsely as abnormality in a driver.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An abnormality detection device configured to detect abnormality in a subject to be driven by a motor via a drive transmission member, the abnormality detection device comprising:

processing circuitry configured to acquire a rotational frequency output signal output from the motor, acquire a motor rotational frequency calculated from the rotational frequency output signal acquired, and distinctively determine abnormality in the subject to be driven and abnormality in the motor based on the rotational frequency output signal acquired and the motor rotational frequency acquired, wherein, upon determining for a first time that the motor rotational frequency acquired is abnormal, the processing circuitry is further configured to determine that the motor is abnormal when the rotational frequency output signal acquired is abnormal and to determine that the subject to be driven is abnormal when the rotational frequency output signal acquired is not abnormal.

2. The abnormality detection device according to claim 1, wherein a period during which abnormality of the rotational frequency output signal is detected, is equal to or shorter than a period in which abnormality of the motor rotational frequency is detected.

3. The abnormality detection device according to claim 1, wherein the motor is controlled by feedback control to bring the motor rotational frequency acquired, close to a target rotational frequency, wherein processing circuitry configured to acquire a motor drive instruction signal generated by the feedback control, and determine whether the subject to be driven has high-load abnormality based on the motor rotational frequency acquired and the motor drive instruction signal acquired.

4. An image forming apparatus with an object to be driven by a motor, the image forming apparatus comprising:

the abnormality detection device of claim 1.

5. The image forming apparatus according to claim 4, wherein the processing circuitry is further configured to, in response to detecting of the abnormality, make a notification of occurrence of the abnormality.

6. The image forming apparatus according to claim 4, further comprising:

a memory to store content of abnormality;

a display to display the content of the abnormality;

a receiver configured to receive an operation; and at least one processor configured to, in response to detecting the abnormality, cause the memory to store content of the abnormality and to, in response to receiving a preset operation, read content of the abnormality corresponding to the preset operation from the memory and cause the display to display the content of the abnormality.

7. The abnormality detection device according to claim 1, wherein processing circuitry includes one or more processors configured to execute computer-readable instructions.

8. The abnormality detection device according to claim 1, wherein processing circuitry includes one of an application specific integrated circuit (ASIC), a digital signal processor (DSP) or a field programmable gate array (FPGA).

9. An abnormality detection device configured to detect abnormality in a subject to be driven by a motor via a drive transmission member, the abnormality detection device comprising:

processing circuitry configured to acquire a rotational frequency output signal output from the motor;

acquire a motor rotational frequency calculated from the rotational frequency output signal acquired;

distinctively determine abnormality in the subject to be driven and abnormality in the motor based on the rotational frequency output signal acquired and the motor rotational frequency acquired, wherein the motor is controlled by feedback control to bring the motor rotational frequency acquired, close to a target rotational frequency;

acquire a motor drive instruction signal generated by the feedback control; and determine whether the subject to be driven has high-load abnormality based on the motor rotational frequency acquired and the motor drive instruction signal acquired, wherein the processing circuitry further configured to, upon determining that the motor rotational frequency acquired is not abnormal, determine that the subject to be driven has the high-load abnormality when the motor drive instruction signal acquired is abnormal, and to determine that the subject to be driven does not have the high-load abnormality when the motor drive instruction signal acquired is not abnormal.

10. An image forming apparatus with an object to be driven by a motor, the image forming apparatus comprising:

the abnormality detection device of claim 9.

11. The image forming apparatus according to claim 10, wherein the processing circuitry is further configured to, in response to detecting of the abnormality, make a notification of occurrence of the abnormality.

12. The image forming apparatus according to claim 10, further comprising:

a memory to store content of abnormality;

a display to display the content of the abnormality;

a receive to receive an operation; and at least one processor configured to, in response to detecting the abnormality, cause the memory to store content of the abnormality and to, in response to receiving a preset operation, read the content of the abnormality corresponding to the preset operation from the memory and cause the display to display the content of the abnormality.

13. The abnormality detection device according to claim 9, wherein processing circuitry includes one or more processors configured to execute computer-readable instructions.

14. The abnormality detection device according to claim 9, wherein processing circuitry includes one of an application specific integrated circuit (ASIC), a digital signal processor (DSP) or a field programmable gate array (FPGA).

15. An abnormality detection device configured to detect that a subject to be driven by a motor controlled by feedback control to bring a motor rotational frequency close to a target rotational frequency has high-load abnormality, the abnormality detection device comprising:

processing circuitry configured acquire the motor rotational frequency of the motor;

acquire a motor drive instruction signal generated by the feedback control; and a determining unit configured to determine whether the subject to be driven has the high-load abnormality based on the motor rotational frequency acquired and the motor drive instruction signal acquired, wherein the processing circuitry is further configured to, upon determining that the motor rotational frequency acquired is not abnormal, determine that the subject to be driven has the high-load abnormality when the motor drive instruction signal acquired is abnormal, and determine that the subject to be driven does not have the high-load abnormality when the motor drive instruction signal acquired is not abnormal.

16. An image forming apparatus with an object to be driven by a motor, the image forming apparatus comprising:

the abnormality detection device according to claim 15.

17. The image forming apparatus according to claim 16, wherein the processing circuitry is configured to, in response to detecting of the abnormality, make a notification of occurrence of the abnormality.

18. The image forming apparatus according to claim 16, further comprising:

a memory to store content of abnormality;

a display to display the content of the abnormality;

a receive to receive an operation; and at least one processor configured to, in response to detecting the abnormality, cause the memory to store content of the abnormality and to, in response to receiving a preset operation, read the content of the abnormality corresponding to the preset operation from the memory and cause the display to display the content of the abnormality.

19. The abnormality detection device according to claim 15, wherein processing circuitry includes one or more processors configured to execute computer-readable instructions.

20. The abnormality detection device according to claim 15, wherein processing circuitry includes one of an application specific integrated circuit (ASIC), a digital signal processor (DSP) or a field programmable gate array (FPGA).

* * * * *